US009230400B2

(12) United States Patent
Aoki et al.

(10) Patent No.: US 9,230,400 B2
(45) Date of Patent: Jan. 5, 2016

(54) DISPLAY MECHANISM FOR VOLATILITY-ALTERATION FEATURES

(71) Applicant: WMS Gaming Inc., Waukegan, IL (US)

(72) Inventors: Dion K. Aoki, Chicago, IL (US); Mary M. Burke, Somonauk, IL (US); Michael R. Bytnar, Naperville, IL (US); Mark A. Hettinger, Glenview, IL (US); Michael W. Mastropietro, Chicago, IL (US); Matthew Wilson, Brookfield, IL (US)

(73) Assignee: Bally Gaming, Inc., Las Vegas, NV (US)

( * ) Notice: Subject to any disclaimer, the term of this patent is extended or adjusted under 35 U.S.C. 154(b) by 245 days.

(21) Appl. No.: 13/833,388

(22) Filed: Mar. 15, 2013

(65) Prior Publication Data

US 2013/0274012 A1 Oct. 17, 2013

Related U.S. Application Data

(60) Provisional application No. 61/624,819, filed on Apr. 16, 2012.

(51) Int. Cl.
*G07F 17/32* (2006.01)

(52) U.S. Cl.
CPC ..... *G07F 17/323* (2013.01); *G07F 17/3244* (2013.01)

(58) Field of Classification Search
CPC ..... G07F 17/323; G07F 17/3244
USPC ..... 463/16, 21, 20, 31
See application file for complete search history.

(56) References Cited

U.S. PATENT DOCUMENTS

| | | | | |
|---|---|---|---|---|
| 3,655,189 | A | 4/1972 | Alexander | 273/88 |
| 3,790,170 | A | 2/1974 | Alexander | 273/88 |
| 6,068,552 | A | 5/2000 | Walker et al. | 463/21 |
| 6,328,649 | B1 | 12/2001 | Randall et al. | 463/20 |
| 6,506,118 | B1 | 1/2003 | Baerlocher et al. | 463/25 |
| 6,596,015 | B1 | 7/2003 | Pitt et al. | 606/232 |
| 6,719,632 | B2 | 4/2004 | Palmer et al. | 463/25 |
| 6,722,983 | B2 | 4/2004 | Kaminkow et al. | 463/26 |
| 6,761,632 | B2 | 7/2004 | Bansemer et al. | 463/16 |
| 6,793,579 | B2 | 9/2004 | Baerlocher et al. | 463/25 |
| 6,939,224 | B2 | 9/2005 | Palmer et al. | 463/16 |
| 7,374,485 | B2 | 5/2008 | Mezen et al. | 463/20 |
| 7,731,579 | B2 | 6/2010 | Gomez et al. | 463/16 |

(Continued)

FOREIGN PATENT DOCUMENTS

| | | |
|---|---|---|
| DE | 196 01 768 A1 | 7/1997 |
| EP | 1 310 924 A2 | 5/2003 |

(Continued)

*Primary Examiner* — Michael Cuff
(74) *Attorney, Agent, or Firm* — Nixon Peabody LLP

(57) ABSTRACT

A gaming system includes an input device, a display device, a processor, and a memory device. The memory device stores instructions that, when executed by the processor, cause the gaming system to receive a wager for playing a wagering game having an overall volatility. A plurality of volatility components are displayed on the display device, the volatility components having respective component ratings. Each component rating contributes to a total rating of the overall volatility. The wagering game is selected from a plurality of wagering games, each of the plurality of wagering games having (a) the same total rating and (b) at least one different component rating.

20 Claims, 10 Drawing Sheets

(56) References Cited

U.S. PATENT DOCUMENTS

| | | | | |
|---|---|---|---|---|
| 8,292,730 | B2 | 10/2012 | Bennett | 463/25 |
| 8,371,927 | B2 | 2/2013 | Englman | 463/20 |
| 8,740,685 | B2 * | 6/2014 | Stevens | G07F 17/32 463/12 |
| 8,827,798 | B2 * | 9/2014 | Nicely | G07F 17/34 463/20 |
| 2001/0034261 | A1 | 10/2001 | Gadot et al. | 463/16 |
| 2002/0013170 | A1 | 1/2002 | Miller et al. | 463/19 |
| 2002/0025846 | A1 | 2/2002 | Bennett | 463/20 |
| 2003/0078093 | A1 | 4/2003 | Simms et al. | 463/20 |
| 2003/0107171 | A1 | 6/2003 | Armstrong et al. | 273/119 |
| 2003/0114218 | A1 | 6/2003 | McClintic | 463/25 |
| 2003/0119586 | A1 | 6/2003 | Crumby | 463/26 |
| 2003/0176215 | A1 | 9/2003 | Palmer et al. | 463/25 |
| 2004/0048646 | A1 | 3/2004 | Visocnik | 463/16 |
| 2004/0082378 | A1 | 4/2004 | Peterson et al. | 463/20 |
| 2004/0121833 | A1 | 6/2004 | Mezen et al. | 463/16 |
| 2004/0235552 | A1 | 11/2004 | Gauselmann | 463/16 |
| 2004/0242302 | A1 | 12/2004 | Baerlocher | 463/16 |
| 2005/0043092 | A1 | 2/2005 | Gauselmann | 463/36 |
| 2005/0064933 | A1 | 3/2005 | Davis | 463/20 |
| 2005/0280213 | A1 | 12/2005 | Kenney et al. | 273/292 |
| 2006/0052151 | A1 | 3/2006 | Gomez | 463/16 |
| 2006/0205476 | A1 | 9/2006 | Jubinville | 463/17 |
| 2006/0281511 | A1 | 12/2006 | Holm et al. | 463/9 |
| 2007/0060297 | A1 | 3/2007 | Hein et al. | 463/20 |
| 2008/0242398 | A1 * | 10/2008 | Harris et al. | 463/25 |
| 2010/0004047 | A1 * | 1/2010 | Acres | 463/20 |
| 2011/0077067 | A1 * | 3/2011 | Ellis | 463/16 |
| 2012/0115585 | A1 * | 5/2012 | Goldman et al. | 463/25 |
| 2012/0129589 | A1 * | 5/2012 | Caputo et al. | 463/20 |

FOREIGN PATENT DOCUMENTS

| | | | |
|---|---|---|---|
| GB | 287788 | | 3/1928 |
| GB | 1 349 339 | | 4/1974 |
| WO | WO 03/082415 | A1 | 10/2003 |
| WO | WO 2004/060512 | A1 | 7/2004 |
| WO | WO 2005/105250 | A2 | 11/2005 |
| WO | WO 2006/033900 | A1 | 3/2006 |

* cited by examiner

FIG. 5A

| | The Question | Volatility Metric | Minimum Values per Category | | | | |
|---|---|---|---|---|---|---|---|
| | | | ☆ | ☆☆ | ☆☆☆ | ☆☆☆☆ | ☆☆☆☆☆ |
| 151 | How often do I get Bonus? | Bonus Frequency | >140 | 140 | 130 | 120 | 110 |
| 152 | What is potential of bonus pay? | Bonus Potential (% of Bonus EV>100x) | 30% | 35% | 40% | 45% | >45% |
| 153 | How consistent is bonus pay? | Bonus Consistency (median/mean bonus) | 40% | 50% | 60% | 75% | >75% |
| 154 | How much of pay is base game? | Base Game Value (Bonus EV) | >30% | 30% | 25% | 20% | 15% |

FIG. 5B

| | The Question | Volatility Metric | Minimum Values per Category | | | | |
|---|---|---|---|---|---|---|---|
| | | | Alex | Buffalo | Cirque | Dessert | Eagle |
| 151 | How often do I get Bonus? | Bonus Frequency | 143 | 143 | 136 | 137 | 144 |
| 152 | What is potential of bonus pay? | Bonus Potential (% of Bonus EV>100x) | 39.14% | 27.64% | 43.03% | 38.54% | 53.8% |
| 153 | How consistent is bonus pay? | Bonus Consistency (median/mean bonus) | 50% | 50% | 41% | 59% | 25% |
| 154 | How much of pay is base game? | Base Game Value (Bonus EV) | 25.72% | 18.78% | 24.33% | 30.43% | 22.1% |

FIG. 5C

| | The Question | Volatility Component | Minimum Values per Category | | | | |
|---|---|---|---|---|---|---|---|
| | | | Alex | Buffalo | Cirque | Dessert | Eagle |
| 151 | How often do I get Bonus? | Bonus Frequency | ☆ | ☆ | ☆☆ | ☆☆ | ☆ |
| 152 | What is potential of bonus pay? | Bonus Potential | ☆☆☆ | ☆ | ☆☆☆☆ | ☆☆☆ | ☆☆☆☆☆ |
| 153 | How consistent is bonus pay? | Bonus Consistency | ☆☆ | ☆☆ | ☆☆ | ☆☆☆ | ☆ |
| 154 | How much of pay is base game? | Base Game Value | ☆☆ | ☆☆☆☆ | ☆☆☆ | ☆ | ☆☆☆ |
| 155 | Is overall volatility the same? | X-Factor | ☆☆☆☆ | ☆☆☆☆ | ☆ | ☆☆☆ | ☆☆ |

DISPLAY MECHANISM FOR VOLATILITY-ALTERATION FEATURES

CROSS-REFERENCE TO RELATED APPLICATIONS

This application claims the benefit of and priority to U.S. Provisional Patent Application No. 61/624,819, titled "Display Mechanism For Volatility-Alteration Features" and filed on Apr. 16, 2012, which is incorporated herein by reference in its respective entirety.

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present invention relates generally to gaming apparatus and methods and, more particularly, to displaying and changing volatility components for a wagering game.

BACKGROUND OF THE INVENTION

Gaming terminals, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for gaming machine manufacturers to continuously develop new games and improved gaming enhancements that will attract frequent play through enhanced entertainment value to the player.

Traditionally gaming machines operate under control of a processor which has been programmed to execute base games and bonus games on the machine according to a predetermined mathematical model, which generally determines the volatility of the gaming machines. For example, the volatility of a game may refer to size of awards versus frequency of the awards. Some players enjoy playing gaming machines with a greater volatility, whereby the size of the awards for winning outcomes is relatively large, but the frequency of awarding the awards is relatively low. Other players enjoy games with a lower volatility, whereby the size of the awards for winning outcomes is relatively small, but the frequency of awarding the awards is relatively high. Players select their volatility by choosing amongst the variety of gaming machines available to be played at a casino.

SUMMARY OF THE INVENTION

According to one aspect of the present invention, a gaming system includes at least one input device, at least one display device, at least one processor, and at least one memory device. The memory device stores instructions that, when executed by the processor, cause the gaming system to receive a wager for playing a wagering game having an overall volatility. A plurality of volatility components are displayed on the display device, the volatility components having respective component ratings. Each component rating contributes to a total rating of the overall volatility. The wagering game is selected from a plurality of wagering games, each of the plurality of wagering games having (a) the same total rating and (b) at least one different component rating.

According to another aspect of the invention, a computer-implemented method in a gaming system includes receiving a wager in response to an input via at least one input device. The method further includes displaying on at least one display device, by at least one of one or more processors, a wagering game including a plurality of volatility components having respective component ratings. Each component rating contributes to a total rating of the overall volatility. The wagering game is selected from a plurality of wagering games, each of the plurality of wagering games having (a) the same total rating and (b) at least one different component rating.

According to yet another aspect of the invention, a computer-implemented method in a gaming system includes receiving a wager in response to an input via at least one input device for playing a wagering game of a plurality of wagering games. The plurality of wagering games includes a first wagering game and a second wagering game. The method further includes displaying on at least one display device, by at least one of one or more processors, a plurality of volatility components with respective component ratings. The component ratings of all components of the plurality of volatility components being indicative of a total rating of an overall volatility. First component ratings are assigned, by at least one of the one or more processors, to each component of the plurality of volatility components for the first wagering game and second component ratings to each component of the plurality of volatility components for the second wagering game. A first total rating of the first component ratings is the same as a second total rating of the second component ratings. At least one of the first component ratings is different than at least one of the second component ratings. The wagering game is selected based on the component ratings.

Additional aspects of the invention will be apparent to those of ordinary skill in the art in view of the detailed description of various embodiments, which is made with reference to the drawings, a brief description of which is provided below.

BRIEF DESCRIPTION OF THE DRAWINGS

FIG. 5A is a table showing correlation between representative symbols and respective values of volatility components.

FIG. 5B is a table showing values of volatility components for a plurality of wagering game.

FIG. 5C is a table showing representative symbols for the values of FIG. 5B.

Figure 1:
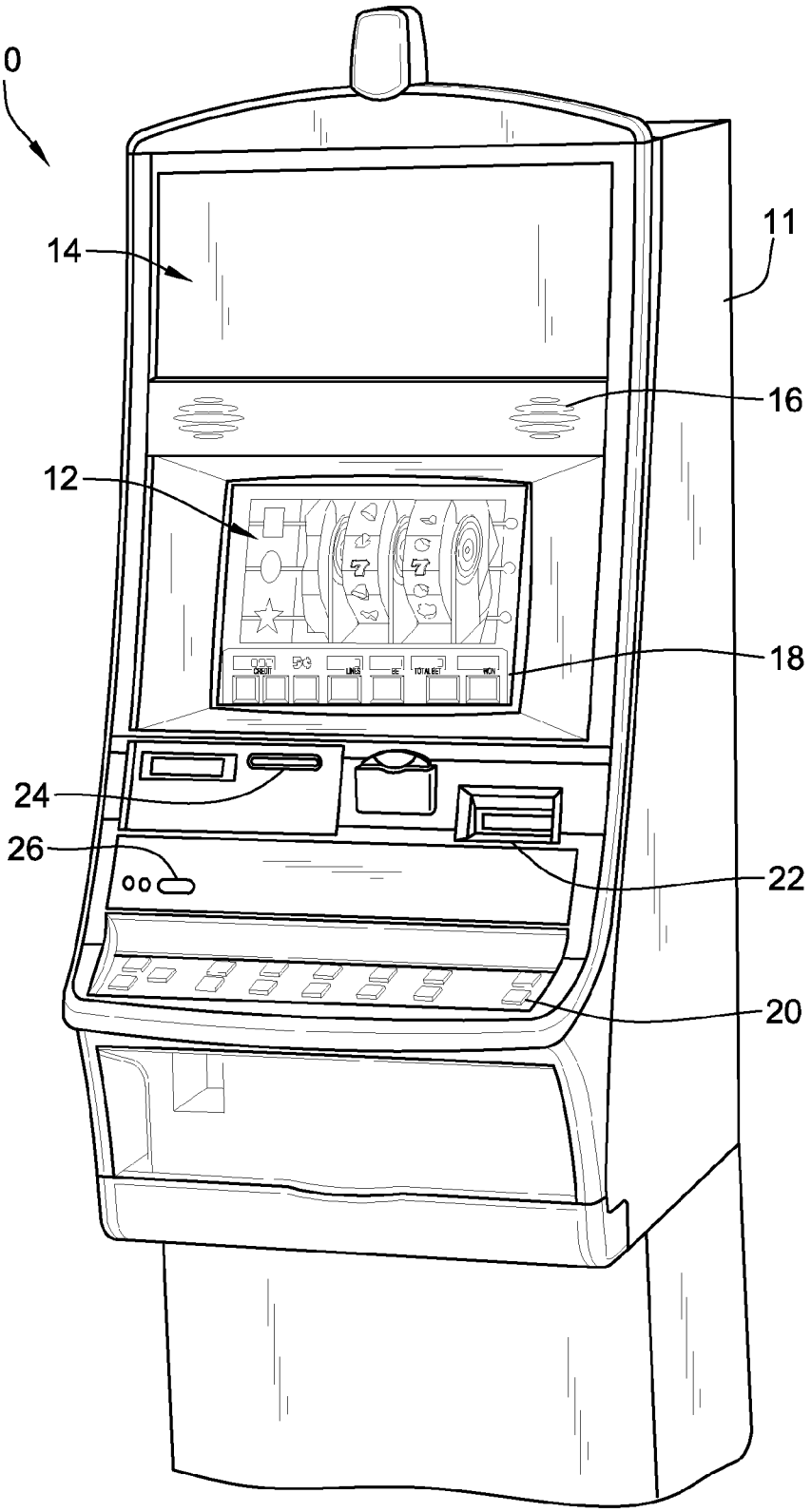
FIG. 1 (PRIOR ART)
FIG. 1 is a perspective view of a free-standing gaming terminal according to an embodiment of the present invention.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated. For purposes of the present detailed description, the singular includes the plural and vice versa (unless specifically disclaimed); the words "and" and "or" shall be both conjunctive and disjunctive; the word "all" means "any and all"; the word "any" means "any and all"; and the word "including" means "including without limitation."

Referring to FIG. 1, there is shown a gaming terminal 10 similar to those used in gaming establishments, such as casinos. With regard to the present invention, the gaming terminal 10 may be any type of gaming terminal and may have varying structures and methods of operation. For example, in some aspects, the gaming terminal 10 is an electromechanical gaming terminal configured to play mechanical slots, whereas in other aspects, the gaming terminal is an electronic gaming terminal configured to play a video casino game, such as slots, keno, poker, blackjack, roulette, craps, etc. The gaming terminal 10 may take any suitable form, such as floor-standing models as shown, handheld mobile units, bartop models, workstation-type console models, etc. Further, the gaming terminal 10 may be primarily dedicated for use in conducting wagering games, or may include non-dedicated devices, such as mobile phones, personal digital assistants, personal computers, etc. Exemplary types of gaming terminals are disclosed in U.S. Pat. No. 6,517,433 and Patent Application Publication Nos. US2010/0062196 and US2010/0234099, which are incorporated herein by reference in their entireties.

The gaming terminal 10 illustrated in FIG. 1 comprises a cabinet 11 that may house various input devices, output devices, and input/output devices. By way of example, the gaming terminal 10 includes a primary display area 12, a secondary display area 14, and one or more audio speakers 16. The primary display area 12 or the secondary display area 14 may be a mechanical-reel display, a video display, or a combination thereof in which a transmissive video display is disposed in front of the mechanical-reel display to portray a video image superimposed upon the mechanical-reel display. The display areas may variously display information associated with wagering games, non-wagering games, community games, progressives, advertisements, services, premium entertainment, text messaging, emails, alerts, announcements, broadcast information, subscription information, etc. appropriate to the particular mode(s) of operation of the gaming terminal 10. The gaming terminal 10 includes a touch screen(s) 18 mounted over the primary or secondary areas, buttons 20 on a button panel, bill validator 22, information reader/writer(s) 24, and player-accessible port(s) 26 (e.g., audio output jack for headphones, video headset jack, USB port, wireless transmitter/receiver, etc.). It should be understood that numerous other peripheral devices and other elements exist and are readily utilizable in any number of combinations to create various forms of a gaming terminal in accord with the present concepts.

Input devices, such as the touch screen 18, buttons 20, a mouse, a joystick, a gesture-sensing device, a voice-recognition device, and a virtual input device, accept player input(s) and transform the player input(s) to electronic data signals indicative of the player input(s), which correspond to an enabled feature for such input(s) at a time of activation (e.g., pressing a "Max Bet" button or soft key to indicate a player's desire to place a maximum wager to play the wagering game). The input(s), once transformed into electronic data signals, are output to a CPU for processing. The electronic data signals are selected from a group consisting essentially of an electrical current, an electrical voltage, an electrical charge, an optical signal, an optical element, a magnetic signal, and a magnetic element.

Figure 2:
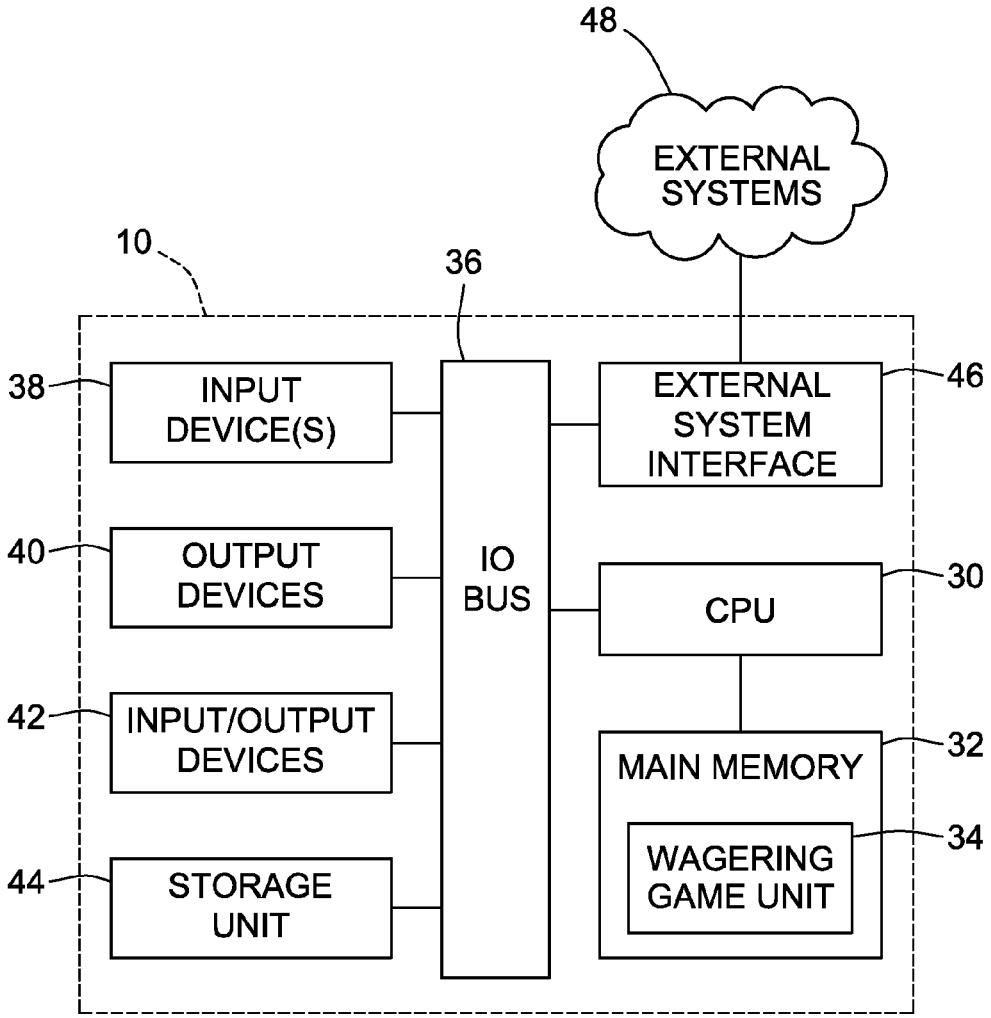
FIG. 2 (PRIOR ART)
FIG. 2 is a schematic view of a gaming system according to an embodiment of the present invention.

Turning now to FIG. 2, there is shown a block diagram of the gaming-terminal architecture. The gaming terminal 10 includes a central processing unit (CPU) 30 connected to a main memory 32. The CPU 30 may include any suitable processor(s), such as those made by Intel and AMD. By way of example, the CPU 30 includes a plurality of microprocessors including a master processor, a slave processor, and a secondary or parallel processor. CPU 30, as used herein, comprises any combination of hardware, software, or firmware disposed in or outside of the gaming terminal 10 that is configured to communicate with or control the transfer of data between the gaming terminal 10 and a bus, another computer, processor, device, service, or network. The CPU 30 comprises one or more controllers or processors and such one or more controllers or processors need not be disposed proximal to one another and may be located in different devices or in different locations. The CPU 30 is operable to execute all of the various gaming methods and other processes disclosed herein. The main memory 32 includes a wagering game unit 34. In one embodiment, the wagering game unit 34 may present wagering games, such as video poker, video black jack, video slots, video lottery, etc., in whole or part.

The CPU 30 is also connected to an input/output (I/O) bus 36, which can include any suitable bus technologies, such as an AGTL+ frontside bus and a PCI backside bus. The I/O bus 36 is connected to various input devices 38, output devices 40, and input/output devices 42 such as those discussed above in connection with FIG. 1. The I/O bus 36 is also connected to storage unit 44 and external system interface 46, which is connected to external system(s) 48 (e.g., wagering game networks).

The external system 48 includes, in various aspects, a gaming network, other gaming terminals, a gaming server, a remote controller, communications hardware, or a variety of other interfaced systems or components, in any combination.

In yet other aspects, the external system 48 may comprise a player's portable electronic device (e.g., cellular phone, electronic wallet, etc.) and the external system interface 46 is configured to facilitate wireless communication and data transfer between the portable electronic device and the CPU 30, such as by a near-field communication path operating via magnetic-field induction or a frequency-hopping spread spectrum RF signals (e.g., Bluetooth, etc.).

The gaming terminal 10 optionally communicates with the external system 48 such that the terminal operates as a thin, thick, or intermediate client. In general, a wagering game includes an RNG for generating a random number, game logic for determining the outcome based on the randomly generated number, and game assets (e.g., art, sound, etc.) for presenting the determined outcome to a player in an audio-visual manner. The RNG, game logic, and game assets are contained within the gaming terminal 10 ("thick client" gaming terminal), the external system 48 ("thin client" gaming terminal), or are distributed therebetween in any suitable manner ("intermediate client" gaming terminal).

The gaming terminal 10 may include additional peripheral devices or more than one of each component shown in FIG. 2. Any component of the gaming terminal architecture may include hardware, firmware, or tangible machine-readable storage media including instructions for performing the operations described herein. Machine-readable storage media includes any mechanism that stores information and provides the information in a form readable by a machine (e.g., gaming terminal, computer, etc.). For example, machine-readable storage media includes read only memory (ROM), random access memory (RAM), magnetic disk storage media, optical storage media, flash memory, etc.

Figure 3:
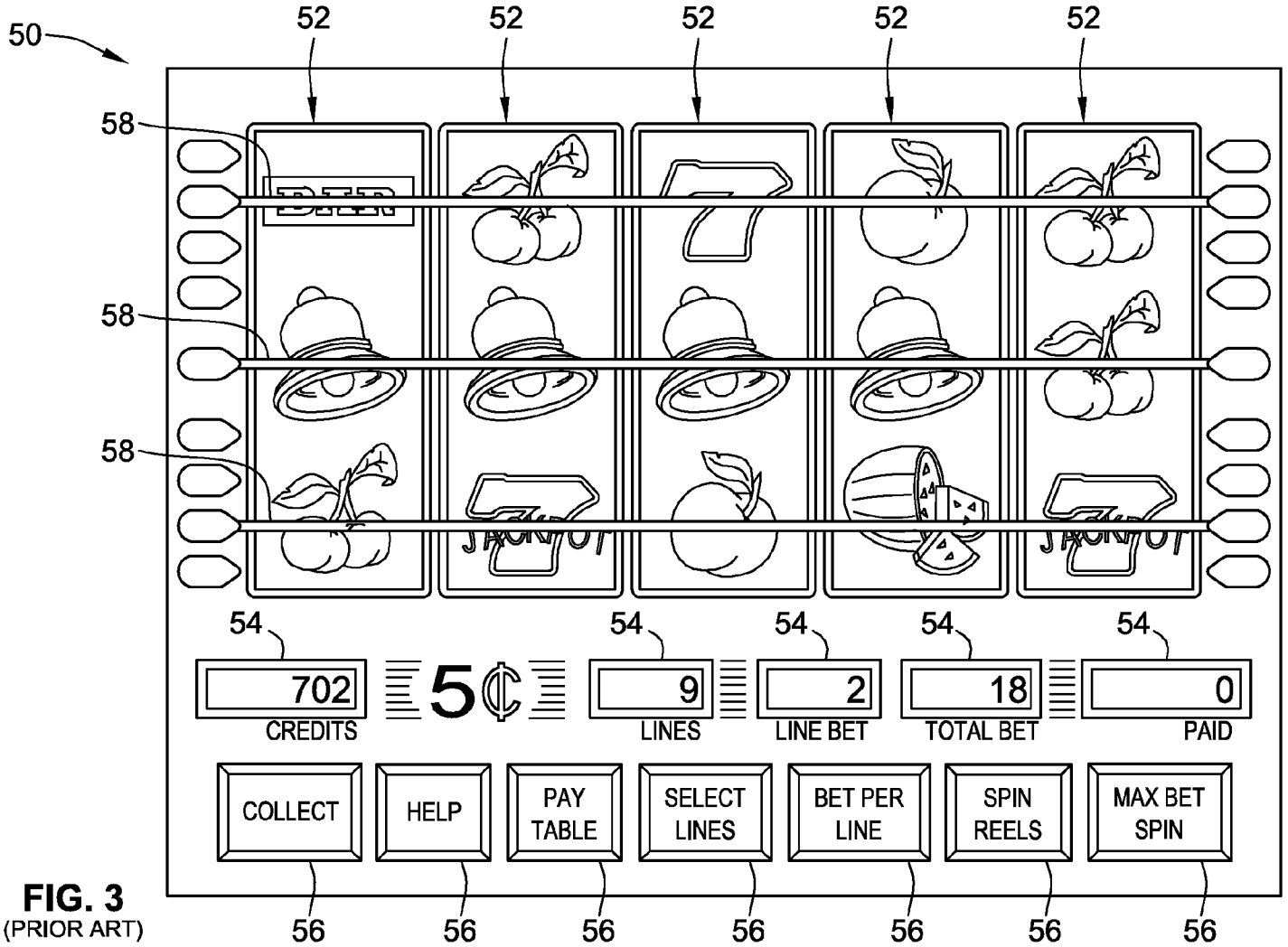
FIG. 3 (PRIOR ART)
FIG. 3 is an image of an exemplary basic-game screen of a wagering game displayed on a gaming terminal, according to an embodiment of the present invention.

Referring now to FIG. 3, there is illustrated an image of a basic-game screen 50 adapted to be displayed on the primary display area 12 or the secondary display area 14. The basic-game screen 50 portrays a plurality of simulated symbol-bearing reels 52. Alternatively or additionally, the basic-game screen 50 portrays a plurality of mechanical reels or other video or mechanical presentation consistent with the game format and theme. The basic-game screen 50 also advantageously displays one or more game-session credit meters 54 and various touch screen buttons 56 adapted to be actuated by a player. A player can operate or interact with the wagering game using these touch screen buttons or other input devices such as the buttons 20 shown in FIG. 1. The CPU operate(s) to execute a wagering game program causing the primary display area 12 or the secondary display area 14 to display the wagering game.

In response to receiving a wager, the reels 52 are rotated and stopped to place symbols on the reels in visual association with paylines such as paylines 58. The wagering game evaluates the displayed array of symbols on the stopped reels and provides immediate awards and bonus features in accordance with a pay table. The pay table may, for example, include "line pays" or "scatter pays." Line pays occur when a predetermined type and number of symbols appear along an activated payline, typically in a particular order such as left to right, right to left, top to bottom, bottom to top, etc. Scatter pays occur when a predetermined type and number of symbols appear anywhere in the displayed array without regard to position or paylines. Similarly, the wagering game may trigger bonus features based on one or more bonus triggering symbols appearing along an activated payline (i.e., "line trigger") or anywhere in the displayed array (i.e., "scatter trigger"). The wagering game may also provide mystery awards and features independent of the symbols appearing in the displayed array.

In accord with various methods of conducting a wagering game on a gaming system in accord with the present concepts, the wagering game includes a game sequence in which a player makes a wager and a wagering game outcome is provided or displayed in response to the wager being received or detected. The wagering game outcome is then revealed to the player in due course following initiation of the wagering game. The method comprises the acts of conducting the wagering game using a gaming apparatus, such as the gaming terminal 10 depicted in FIG. 1, following receipt of an input from the player to initiate the wagering game. The gaming terminal 10 then communicates the wagering game outcome to the player via one or more output devices (e.g., primary display 12 or secondary display 14) through the display of information such as, but not limited to, text, graphics, static images, moving images, etc., or any combination thereof. In accord with the method of conducting the wagering game, the CPU transforms a physical player input, such as a player's pressing of a "Spin Reels" touch key, into an electronic data signal indicative of an instruction relating to the wagering game (e.g., an electronic data signal bearing data on a wager amount).

In the aforementioned method, for each data signal, the CPU (e.g., CPU 30) is configured to process the electronic data signal, to interpret the data signal (e.g., data signals corresponding to a wager input), and to cause further actions associated with the interpretation of the signal in accord with computer instructions relating to such further actions executed by the controller. As one example, the CPU causes the recording of a digital representation of the wager in one or more storage media (e.g., storage unit 44), the CPU, in accord with associated computer instructions, causing the changing of a state of the storage media from a first state to a second state. This change in state is, for example, effected by changing a magnetization pattern on a magnetically coated surface of a magnetic storage media or changing a magnetic state of a ferromagnetic surface of a magneto-optical disc storage media, a change in state of transistors or capacitors in a volatile or a non-volatile semiconductor memory (e.g., DRAM), etc. The noted second state of the data storage media comprises storage in the storage media of data representing the electronic data signal from the CPU (e.g., the wager in the present example). As another example, the CPU further, in accord with the execution of the instructions relating to the wagering game, causes the primary display 12, other display device, or other output device (e.g., speakers, lights, communication device, etc.) to change from a first state to at least a second state, wherein the second state of the primary display comprises a visual representation of the physical player input (e.g., an acknowledgement to a player), information relating to the physical player input (e.g., an indication of the wager amount), a game sequence, an outcome of the game sequence, or any combination thereof, wherein the game sequence in accord with the present concepts comprises acts described herein. The aforementioned executing of computer instructions relating to the wagering game is further conducted in accord with a random outcome (e.g., determined by a RNG) that is used by the CPU to determine the outcome of the game sequence, using a game logic for determining the outcome based on the randomly generated number. In at least some aspects, the CPU is configured to determine an outcome of the game sequence at least partially in response to the random parameter.

Figure 4:
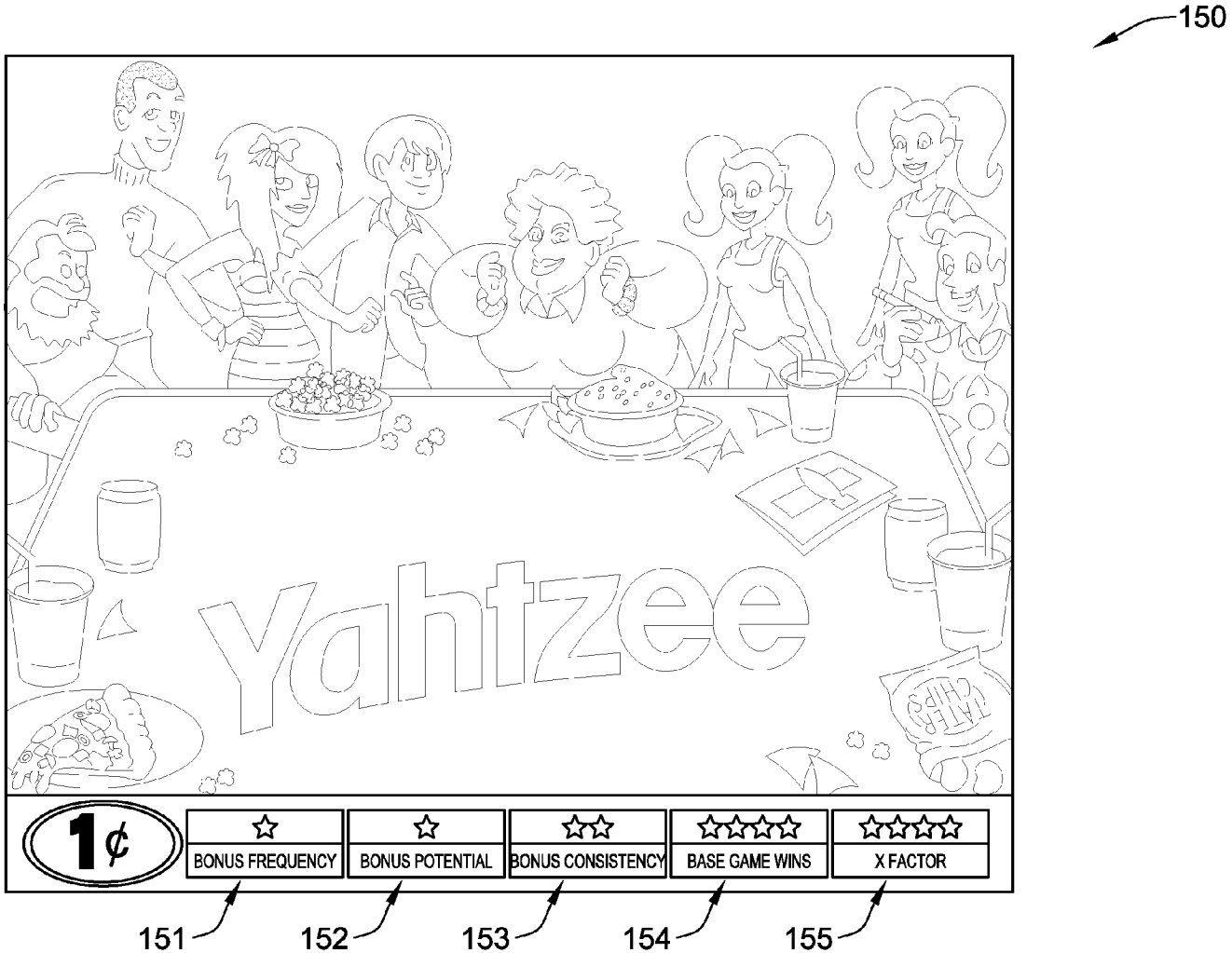
FIG. 4 is a an image of an exemplary game screen displaying a plurality of volatility components for a wagering game.

Referring now to FIG. 4, an image of a game screen 150 is adapted to be displayed on the primary display area 12 or the secondary display area 14. The game screen 150 portrays a Yahtzee® wagering game, which includes displaying a plurality of volatility components 151-155 near the bottom of the screen. The volatility components 151-155 are indicative of an overall volatility of the wagering game and are rated in accordance with a rating system.

For example, each of the volatility components 151-155 is rated with a component rating selected from a range varying from a minimum rating of one star to a maximum rating of five stars. The star ratings are representative of metric values for each of the volatility components 151-155. In another example, money bags are used as symbols instead of star symbols. A minimum rating, represented by a single star symbol, indicates the lowest volatility assigned to the respective volatility component. A maximum rating, represented by five star symbols, indicates the highest volatility assigned to the respective volatility component.

A first volatility component 151 is directed to bonus frequency. This component of the overall volatility is indicative of how often a bonus game is triggered. In the illustrated example, the Yahtzee® wagering game has a minimum rating of one star. Thus, the Yahtzee® wagering game has a low volatility with respect to how often bonuses are triggered. Because bonus frequency is inversely proportional with volatility value, this means that a player will expect the Yahtzee® wagering game to trigger the most frequent bonus games (in contrast to a game with the greatest volatility possible in which bonus games are triggered least frequently).

A second volatility component 152 is directed to bonus potential. This component of the overall volatility is indicative of the potential of the bonus pay (i.e., how much of a payout amount can be won during the bonus game). For example, the bonus potential 152 is measured by expected value ("EV") in bonus wins over 100× bet. In other words, the bonus potential 152 is determined based on a percentage of the bonus EV as averaged, for example, over the course of 10,000 wagers. In the Yahtzee® wagering game, the bonus potential 152 has the minimum rating of one star. This means that a player of the Yahtzee® wagering game will, on average, win the smallest payout amount, relatively speaking.

A third volatility component 153 is directed to bonus consistency. This component of the overall volatility is indicative of the predictability of the bonus game (i.e., how volatile is the bonus game standing alone). One way of measuring the bonus consistency is to calculate an average median/mean of the bonus game. In the Yahtzee® wagering game, the bonus consistency 153 has a component rating of two stars. This means that the Yahtzee® wagering game is next-to-least consistent in how consistent the bonus pay is awarded.

A fourth volatility component 154 is directed to base-game wins. This component of the overall volatility is indicative of how volatile the base game is in awarding winning outcomes. The base-game-wins component 154 refers to the base game standing alone, without bonus features or bonus games. In the Yahtzee® wagering game, the base-game-wins component 154 has a component rating of four stars. A higher percentage of base-game wins corresponds to a lower component rating (i.e., lower volatility), while a lower percentage of base-game wins corresponds to a higher component rating (i.e., higher volatility). This means that the Yahtzee® wagering game has the next-lowest percentage of contribution from the base game (i.e., the Yahtzee® wagering game has the next-highest volatility for the base-game-wins component 154).

A fifth volatility component 155 is generally a catch-all "X"-factor component used for balancing the overall volatility. Specifically, the "X"-factor component 155 ensures that the overall volatility appears constant regardless of changes to the component rating of any of the volatility components 151-155. For example, it is assumed that the overall volatility of the Yahtzee® wagering game has a total rating of twelve stars. According to the illustrated component rating of the first four volatility components 151-154, the total rating is only eight stars. As such, to maintain the overall volatility constant, the "X"-factor component must have a component rating of four stars: component rating of "X"-factor component (four stars)=total rating (twelve stars)−sum of component rating for each of the first four volatility components 151-154 (one star+one star+two stars+four stars).

The "X"-factor component contributes to the overall volatility as and if needed. For example, if the sum of the component rating for each of the first four volatility components 151-154 is equal to the total rating of the overall volatility, the "X"-factor component is not necessary (and, thus, not used). Specifically, the "X" factor may be utilized to ensure that different wagering games, of different star distributions in the first four volatility components 151-154 have the same overall number of stars. As such, players will not be discouraged from playing a particular game because it has fewer volatility stars than another game.

Referring to FIGS. 5A-5C, an illustrative example compares the volatility of different wagering games. In this example, the constant value for the total rating of the overall volatility is assumed to be twelve stars. In FIG. 5A, a table shows the correlation between the numerical values assigned to each volatility metric and the corresponding representative symbols. For example, the bonus-frequency metric (which is directed to answering the question "How often do I get bonus") has a minimum component rating of one star assigned to a frequency of triggered bonus games that is greater than 140 bonus games; a component rating of two stars assigned to a frequency of at least 140 bonus games; a component rating of three stars assigned to a frequency of at least 130 bonus games; a component rating of four stars assigned to a frequency of at least 120 bonus games; and a component rating of five stars assigned to a frequency of at least 110 bonus games. Similarly, other ones of the volatility metrics have respective numerical values assigned to corresponding representative symbols.

In FIG. 5B, a table shows numerical values assigned to each volatility metric for the different wagering games. For example, the wagering game "Alex" has a bonus frequency 151 of 143 triggered bonus games, a bonus potential 152 of 39.15%, a bonus consistency 153 of 50%, and a base-game wins (or value) 154 of 25.72%.

In FIG. 5C, these numerical values are displayed to the player via corresponding star symbols. As such, in accordance with the assignment of the star rating illustrated in the table of FIG. 5A, the bonus frequency 151 of 143 triggered bonus games is displayed using the corresponding single star, the bonus potential 152 of 39.15% is displayed using the corresponding three star symbols, the bonus consistency 153 of 50% is displayed using the corresponding two star symbols, and the base-game wins 154 of 25.72% is displayed using the corresponding two star symbols. Because the total sum of the volatility components 151-154 of the wagering game "Alex" is equal to eight stars, the "X" Factor volatility component 155 is assigned (and displayed as) four star symbols to achieve the desired total rating of twelve stars for the overall volatility of each of the wagering games.

Figure 6:
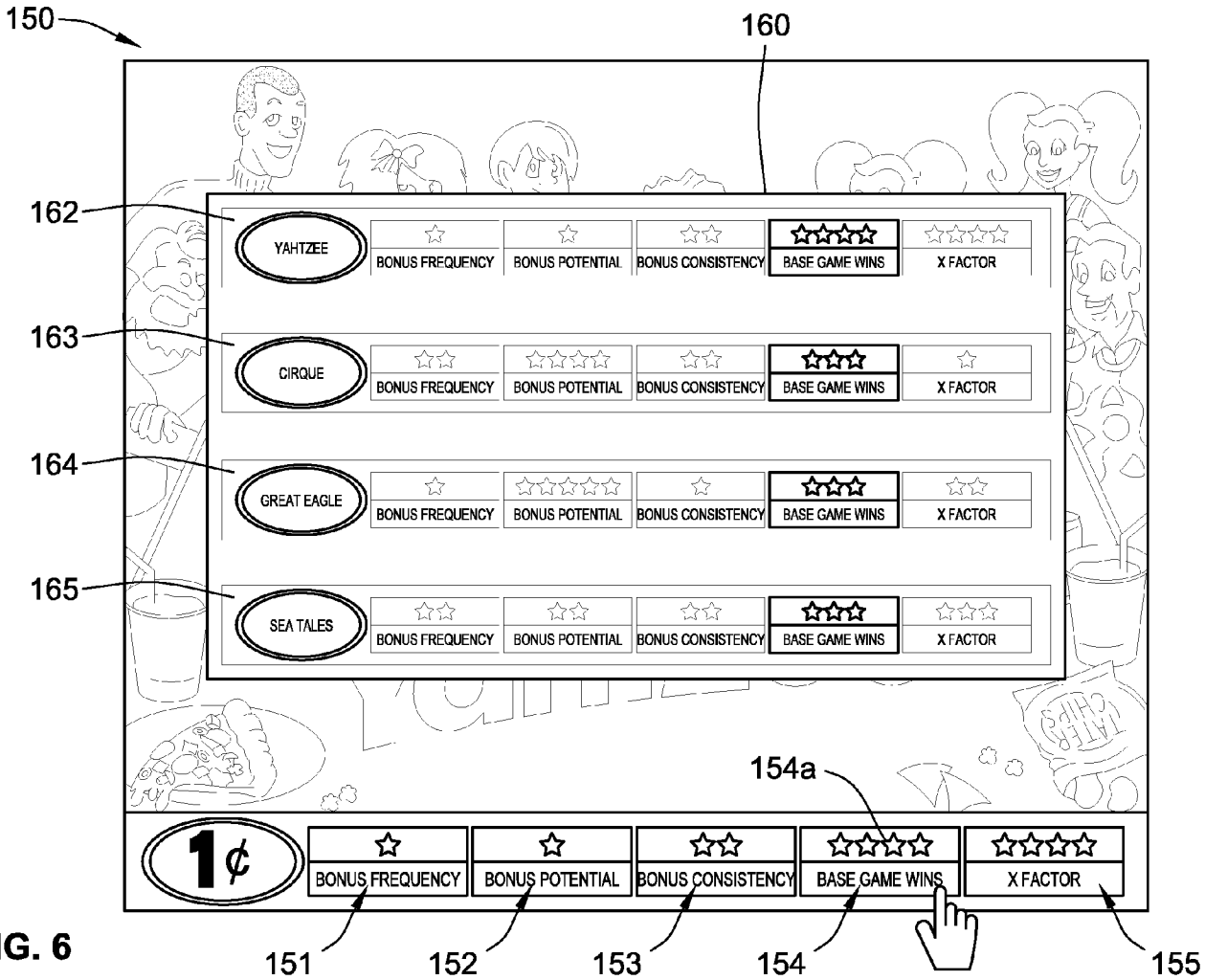
FIG. 6 is an image of an exemplary game screen displaying a menu of selectable games with associated volatility components values.

Referring to FIG. 6, the game screen 150 portrays a selection menu 160 in which a plurality of options are displayed for player selection of a desired wagering game. For example, the player may wish to change the current Yahtzee® wagering game to a different game. Assuming that the base-game wins 154 is an important volatility component to the player, the player presses a button 154*a* associated with the base-game-wins volatility component 154. In response, the selection menu 160 displays to the player a plurality of selectable options 162-165 for selecting wagering games that have the same or similar component rating as the Yahtzee® wagering game.

For example, the selectable options 162-165 include a Yahtzee® option 162 (i.e., continue playing the current game), a Cirque option 163, a Great Eagle option 164, and a Sea Tales option 165. Based on the different component ratings of each wagering game, the player can select the desired wagering game. For example, if the player is interested to change from the current low-bonus-potential volatility 152 to a greater potential volatility 152, the player would select the Great Eagle option 164 (which has the greatest component rating of five stars) or the Cirque option 163 (which has the next-greatest component rating of four stars). To determine whether to choose the Great Eagle wagering game or the Cirque wagering game, the player would have to determine whether he or she would rather prefer the greatest bonus potential 152 of five stars with a lower bonus frequency 151 of one star (of the Great Eagle game), or the next-greatest bonus potential 152 of four stars with a slightly greater bonus frequency 151 of two stars (of the Cirque game).

Thus, the breakdown and/or comparison of the wagering games based on one or more of the volatility components 151-155 can be utilized by players to better understand how volatility is implement in a particular game. Similarly, the breakdown can also be utilized, for example, by casino personnel (e.g., slot floor managers) to better and more quickly understand how games are related mathematically. Based on this understanding, the casino personnel should know better which games are preferred by the players, and, therefore, which games should be purchased.

Figure 7:
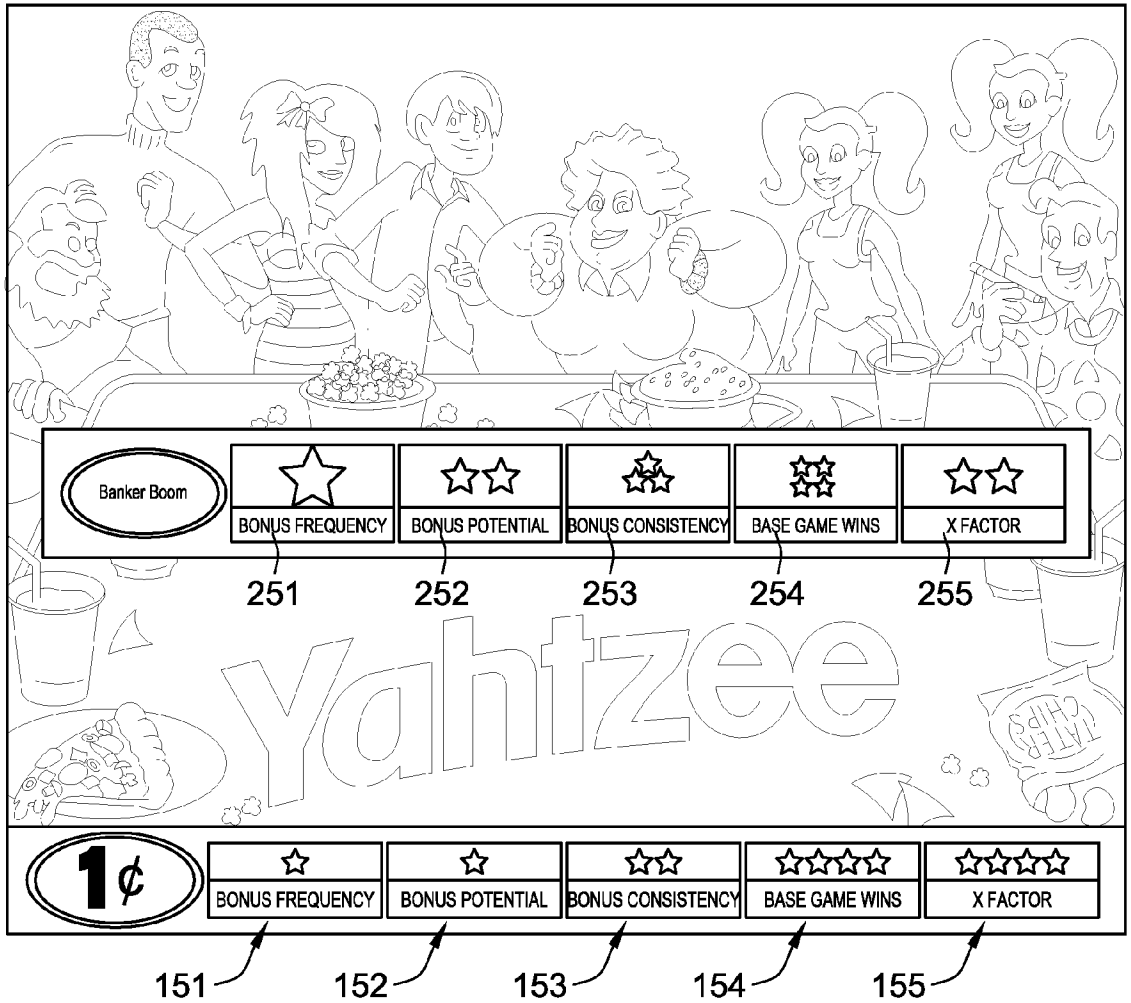
FIG. 7 shows a volatility system in which volatility values are represented in accordance with the size and number of symbols.

Referring to FIG. 7, the game screen 150 displays a rating system in which the volatility component rating is represented by both the number and the size of the star symbols. For example, when a volatility component 251-255 is highly volatile a single large star symbol is displayed, but when the volatility component is not very volatile a plurality of smaller star symbols are displayed. The overall size of the plurality of smaller stars is equal to the size of the single large star symbol.

As such, for example, the bonus frequency 251 has a component rating represented by a single large star symbol, which is generally equal in size to an overall size of the two star symbols representing the bonus potential 252. Thus, each of the two stars of the bonus potential 252 have a size is that is approximately half the size of the single star of the bonus frequency 251. In another example, the base-game wins 254 has a component rating represented by four stars, each of the stars having a size that is approximately a quarter in size relative to the single star of the bonus frequency 251.

Optionally, the rating system can be reversed to have a small number of symbols represent a high volatility and a large number of symbols represent a low volatility. According to this system, a single large star may indicate a high volatility and five small stars may indicate a low volatility. Thus, a player may quickly understand that a volatility component with a single large star indicates a highly volatile event in which the player will receive fewer award outcomes (e.g., the number of stars being directly proportional to the number of award outcome), but those awards will be larger in value (e.g., the single star has a size that is directly proportional to the size of the awards). Nevertheless, the overall payouts, regardless of the rating, remain the same because the overall volatility is constant.

Figure 8:
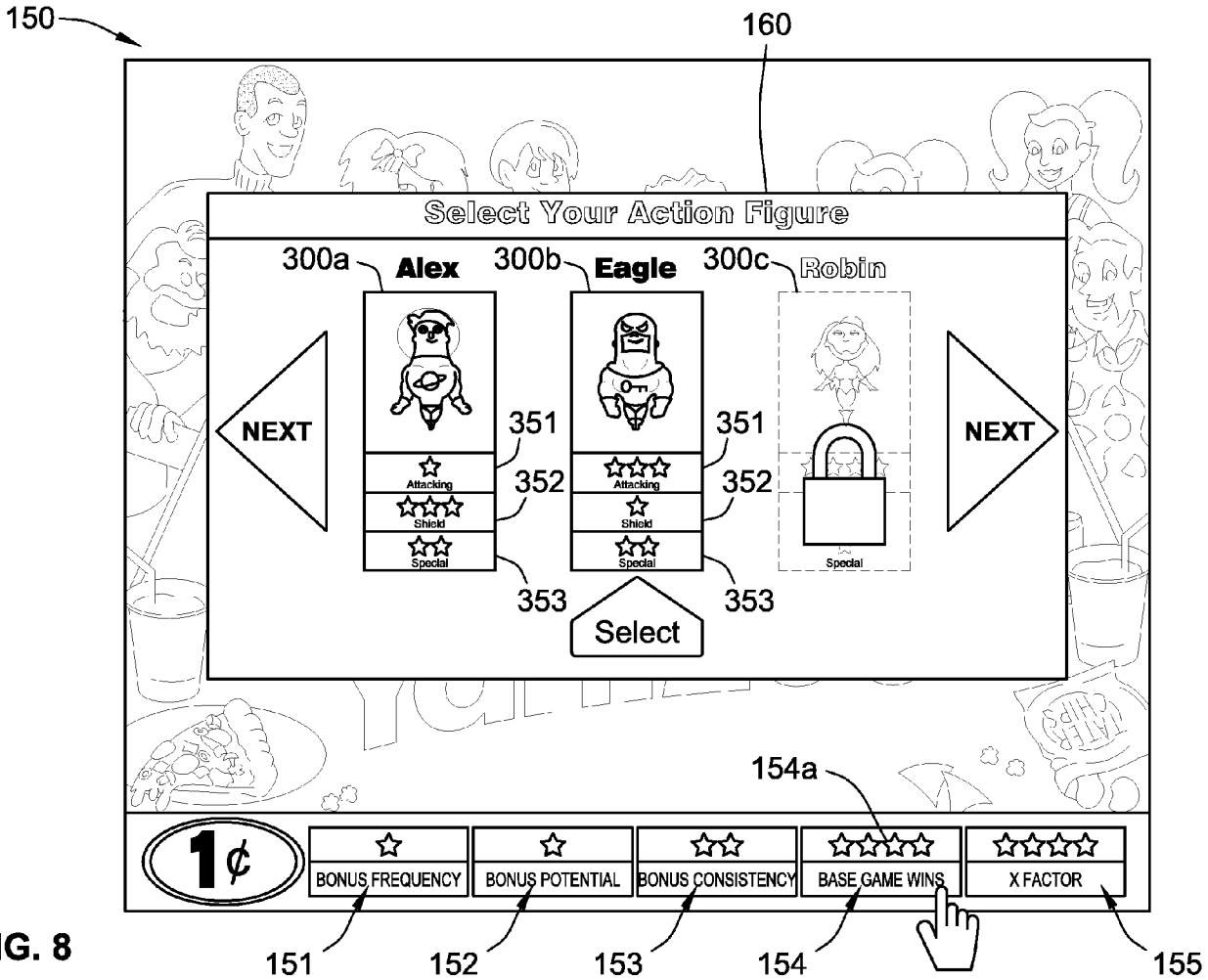
FIG. 8 is an image of an exemplary game screen displaying a plurality of selectable characters with associated volatility components values.

Referring to FIG. 8, the game screen 150 displays a the selection menu 160 with a plurality of player-selectable characters **300*a*-300*c* that have one or more associated game-play components. The player can select one of the characters 300*a*-300*c*, with each character having a unique set of attributes that may be applied across different wagering games or just in the current game. For example, the characters 300*a*-300*c* may be associated with one or more of volatility components 351-353. By selecting a specific character, the player can adjust the volatility components 351-353**.

The selected character could be the player's avatar that the player associates with himself, and any game across the casino that allows customization could be automatically customized based on the attributes of the selected avatar. Additionally, this flexibility provides a platform that can be extended such that certain characters provide their own bonuses, skinning, and/or art for a base game.

One unique aspect of allowing volatility to be adjusted via selection of a character is that characters may be unlockable over time (e.g., the "Robin" character **300*c*** is displayed in a de-emphasized manner to represent its current locked status). Thus, unlike a typical volatility selection that either (a) allows the player to select any volatility level or (b) expressly locks the player out from certain volatilities (which is likely to result in player frustration), this manner of adjusting volatility makes it relatively hidden from the player that he or she is being restricted from selecting particular volatilities. Instead, the player is likely to perceive locked characters (with the corresponding locked volatility adjustments) as a goal to unlock those characters.

For example, it may be desirable to prevent a player form adjusting a game to a highly volatile state until the player has played the game for a certain length of time and, accordingly, has grown to like the game itself. Thus, a highly volatile character may not become unlocked to the player until the player has played, for example, 100 game instances of a particular wagering game.

In alternative embodiments, volatility selection is represented based on various symbols and/or environments. According to one example, a bonus game offers a gear shifter for changing the evaluation of outcomes. The gear shifter can be adjustable between at least two positions (e.g., a lower gear and a high gear). For example, wins are represented by passing cars on straight-aways illustrated in dynamically generated corners of the game screen 150. If the gear shifter is in a low gear, the wins will be frequent, but smaller. In the low gear, the volatility can be represented by numerous smaller cars moving in the dynamically generated corners. If the gear shifter is in a high gear, the wins will be less frequent, but larger. Correspondingly, the volatility can be represented by a few larger cars moving in the dynamically generated corners.

In one example, the gear shifter is in a locked position during game-play, similar to a mechanical reel pull-arm. In another example, instead of being locked, the gear shifter is dynamically positioned during game-play. For example, the gear shifter is in an initial position recorded at the time that an initial game-event trigger determines a path or outcome presented to the player. When a next game-event trigger occurs, the gear shifter is dynamically adjusted to a second position for determining the path or outcome presented to the player.

In an alternative example, a Monopoly® themed wagering game may offer a vehicle for Mr. Monopoly® to drive. Based on the vehicle selected, the game volatility is determined. In a specific example, the player may select a vehicle periodically during game-play. For example, a train may offer smaller, but more frequent wins; a luxury car may offer larger, but moderately frequent wins; and a sports car may offer large, but infrequent wins.

Volatility can optionally be determined based on a choice of environment, venue, track, and/or location. For example, a base or bonus game of the wagering game may be themed for a cross-country journey. The path offered on this journey, which may end at any time, offers a way to select a desired volatility. For example, a long path may offer frequent, small wins, but a short path offers infrequent, large wins.

In another example, the player is shown environmental conditions for the journey. A wintery, icy road offers high volatility since a vehicle may make obtaining a winning outcome more difficult, but more rewarding. A clear sky, summer day can offer smaller wins, but observed more often.

In yet another example, the wagering game offers a choice of race tracks. The race tracks can display high-performance cars on a track with many turns, position changes between the cars, goal markers, etc. A race track with shorter corners and goal markers set closely apart may represent a game with a low volatility. A race track with longer corners and goal markers set further apart may represent a game with a high volatility.

Figure 9A:
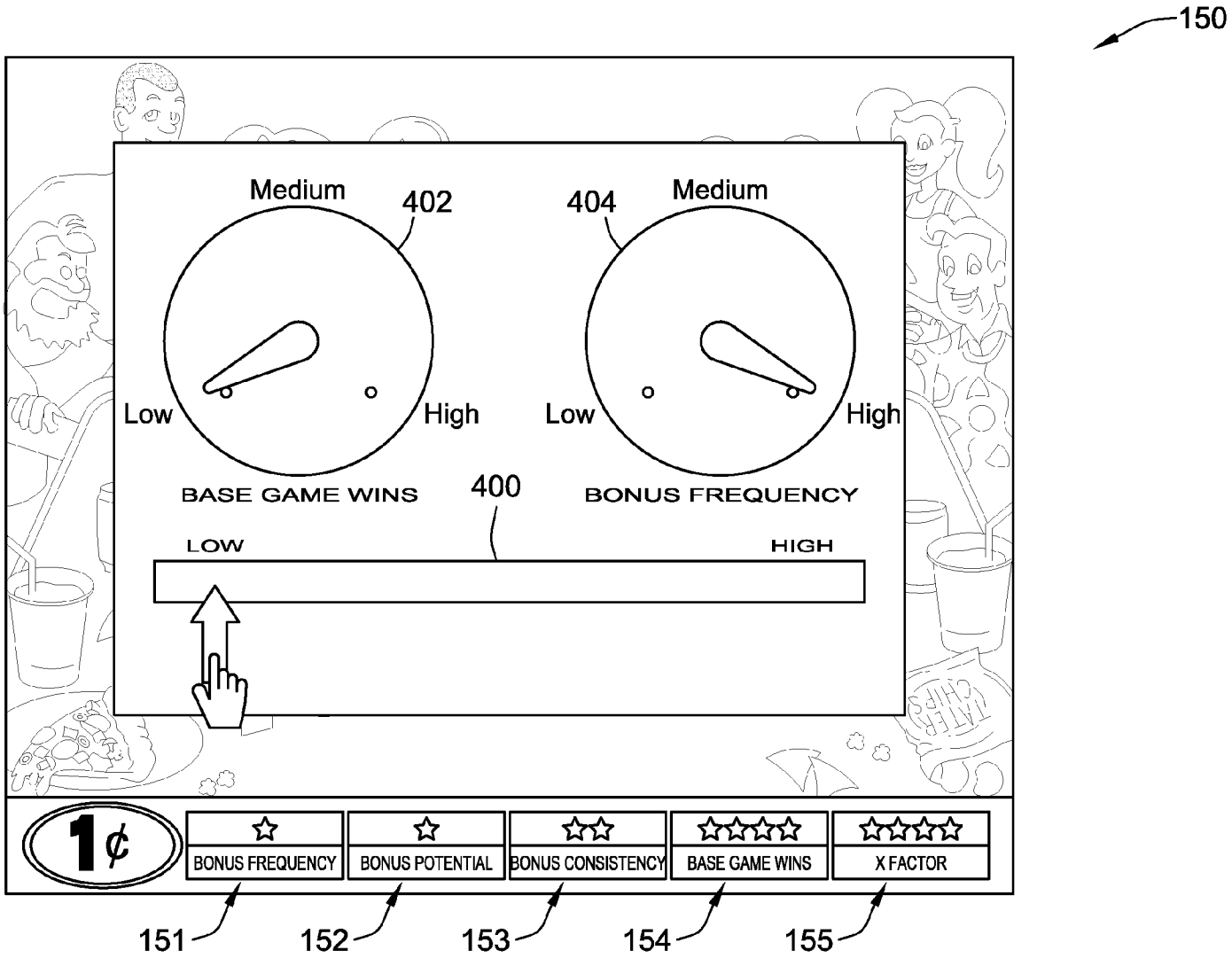
FIG. 9A is an image of an exemplary game screen displaying a volatility-selector in a LOW volatility position.
Figure 9B:
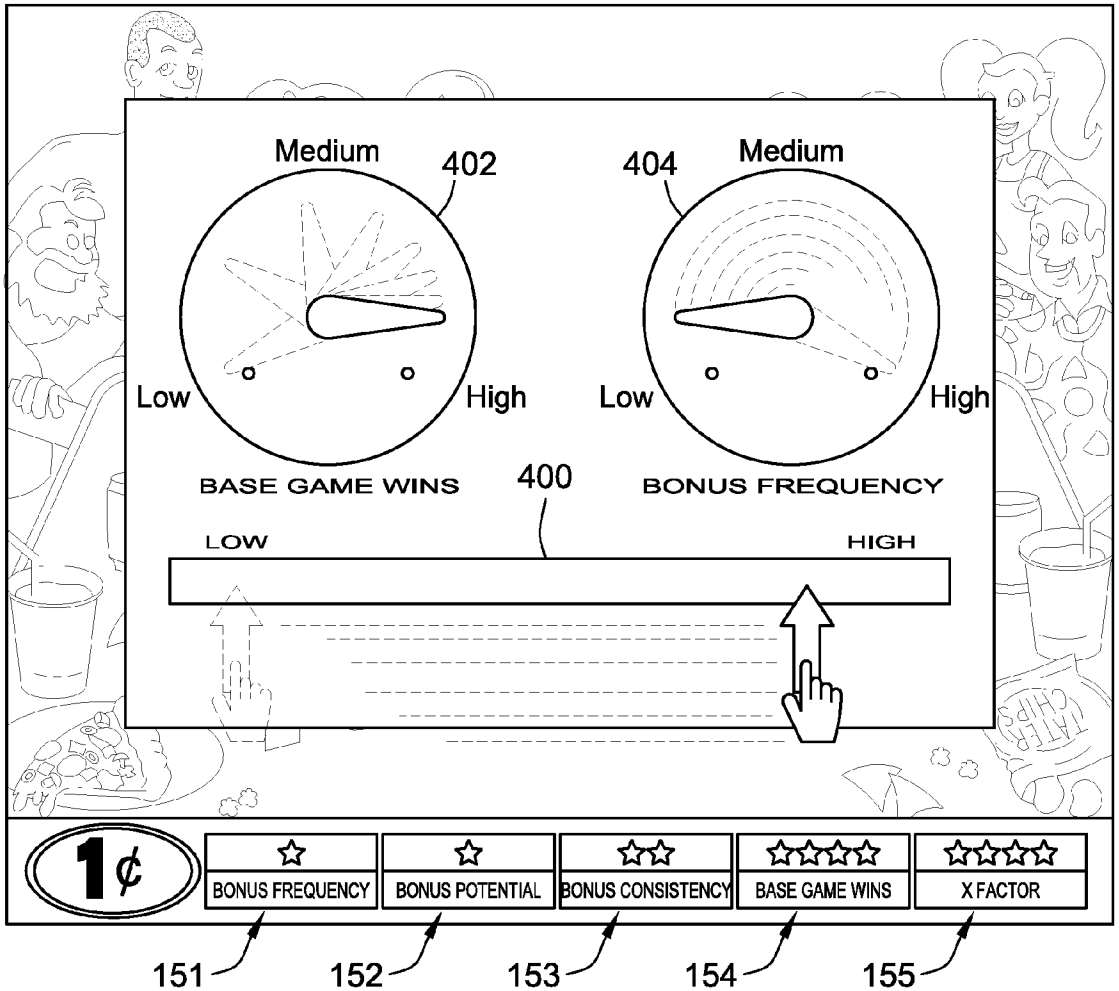
FIG. 9B shows the volatility-selector of FIG. 9A in a HIGH volatility position.

Referring to FIGS. 9A and 9B, the game screen 150 shows a volatility-selector slide 400 that a player can position anywhere from a LOW position to a HIGH position. As the player moves the slide 40 from a LOW position to a HIGH position, two gauges 402, 404 are adjusted to illustrate to the player what the current volatility means from a relative standpoint. For example, a first gauge 402 is associated with the Base-game-wins volatility component and a second gauge 404 is associated with the Bonus Frequency volatility component. Each of the gauges 402, 404 has corresponding primary LOW, MEDIUM, and HIGH positions (with many intermediate positions in-between the primary positions).

As the player moves the slide 400 from the LOW position to the HIGH position, the Base-game wins gauge 402 also moves to illustrate that the amount of the wins has increased. Simultaneously, to maintain the overall volatility intact, the Bonus Frequency gauge 404 moves to illustrate that the frequency of the wins has decreased.

Optionally, a side wager can be used, for example, as a side bet to increase the amount of Base-game wins 402 without lowering the Bonus Frequency 404. In this example, the overall volatility is changed based on the additional side wager.

An alternative embodiment is directed to providing separate monetary and non-monetary volatilities. In this embodiment, volatilities for monetary aspects of wagering games are controllable and selectable independently from non-monetary aspects. Because monetary aspects are heavily regulated (in contrast to non-monetary aspects, which are allowed more freedom), treating non-monetary aspects independently allows unique volatilities to be created for non-regulated aspects of wagering games. For example, in episodic gaming where players collect assets (e.g., miles, medals, player-tracking points, award displays, audio/visual celebrations, etc.) to unlock EV-neutral content, the volatility of the assets awarding can be set to highly volatile, while the wagering (i.e., monetary) aspect of the wagering game can remain unchanged.

Another alternative embodiment is directed to representing volatility classification by generally accepted everyday terms. For example, the volatility components can be represented in terms of a financial portfolio. Most players are likely familiar with financial investment strategies, which include risky and safe strategies. For example, depositing money into a savings account or purchasing bonds provides a smaller risk for an investor, and, consequently, the potential rewards is minimal. However, purchasing penny stocks or stock-options are generally considered high-risk investments, and, consequently, the payouts are potentially very lucrative. Using the portfolio approach, the player can choose to invest their spins in either a low-risk or a high-risk investment model (e.g., a low volatility model or a high volatility model).

Some options that can be presented for the portfolio approach can include (a) a low risk portfolio (less risk, less reward), (b) a balanced portfolio (medium risk, medium reward), and (c) a high risk portfolio (more risk, more reward). By using terms and associations with real-life money investments, the player may discern more readily the consequences of their decision in changing volatility options.

Each of these embodiments and obvious variations thereof is contemplated as falling within the spirit and scope of the claimed invention, which is set forth in the following claims.

What is claimed is:

1. A gaming system comprising:

a gaming machine primarily dedicated to playing at least one casino wagering game, the gaming machine including a gaming cabinet, an electronic display device, and one or more electronic input devices, the electronic display device and the one or more input devices being coupled to the gaming cabinet, the one or more electronic input devices configured to detect a physical item associated with a monetary value that establishes a credit balance and to receive a cashout input that initiates a payout from the credit balance, the credit balance changing based on play of the casino wagering game;

a random element generator configured to generate one or more random elements; and one or more controllers configured to:

initiate the casino wagering game in response to a wager input, the wager input decreasing the credit balance, the casino wagering game having an overall volatility, randomly select an outcome of the casino wagering game based, at least in part, on the one or more random elements, direct the electronic display device to display the outcome and a plurality of volatility components having respective component ratings, each component rating contributing to a total rating of the overall volatility, select the casino wagering game from a plurality of casino wagering games, each of the plurality of casino wagering games having (a) the same total rating and (b) at least one different component rating, and award an award in response to the outcome meeting a predetermined award criterion.

2. The gaming system of claim 1, wherein the plurality of volatility components includes one or more of (i) a bonus-frequency component, (ii) a bonus-potential component, (iii) a bonus-consistency component, (iv) a base-game-wins component, and (v) an "X"-factor component.

3. The gaming system of claim 1, wherein each component rating is represented via one or more symbols.

4. The gaming system of claim 3, wherein each component rating is indicated based on one or more of (i) the number of the symbols and (ii) the size of the symbols.

5. The gaming system of claim 3, wherein a smaller number of the symbols having a larger size is indicative of a higher overall volatility, a larger number of the symbols having a smaller size being indicative of a lower overall volatility.

6. The gaming system of claim 1, wherein a player-selectable character of a plurality of player-selectable characters is associated with one or more volatility components of the plurality of volatility components.

7. The gaming system of claim 6, wherein the plurality of player-selectable characters includes an unlockable character, the unlockable character being unlocked based on time of gameplay.

8. The gaming system of claim 1, wherein a bonus game of the casino wagering game is triggered in response to a triggering event, the bonus game displaying player selections for changing individual ones of the plurality of volatility components.

9. The gaming system of claim 8, wherein the player selections are offered periodically during gameplay.

10. The gaming system of claim 1, wherein a volatility-selector is displayed on the electronic display device, the volatility-selector changing, in response to receiving a player selection, volatility settings between a low volatility setting and a high volatility setting.

11. The gaming system of claim 10, wherein changes to the volatility-selector automatically adjust each component rating of the plurality of volatility components.

12. The gaming system of claim 11, wherein the changes to the volatility-selector increase the component rating of a first component of the plurality of volatility components and decrease the component rating of a second component of the plurality of volatility components.

13. A method of operating a gaming system, the gaming system including a random element generator, one or more controllers, and a gaming machine, the gaming machine primarily dedicated to playing at least one casino wagering game, the gaming machine including a gaming cabinet, an electronic display device, and one or more electronic input devices, the electronic display device and the one or more electronic input devices being coupled to the gaming cabinet, the method comprising:

detecting, via at least one of the one or more electronic input devices, a physical item associated with a monetary value, the monetary value establishing a credit balance that changes based on play of the casino wagering game;

generating one or more random elements with the random element generator;

receiving, via at least one of the one or more electronic input devices, a wager input to initiate the casino wagering game, the wager input decreasing the credit balance;

randomly selecting, by the one or more controllers, an outcome of the casino wagering game based, at least in part, on the one or more random elements;

displaying the outcome on the electronic display device;

displaying a plurality of volatility components of the casino wagering game on the electronic display device, the plurality of volatility components having respective component ratings, each component rating contributing to a total rating of the overall volatility;

selecting the casino wagering game from a plurality of casino wagering games, each of the plurality of casino wagering games having (a) the same total rating and (b) at least one different component rating;

awarding, by the one or more controllers, an award in response to the outcome meeting a predetermined award criterion; and receiving, via at least one of the one or more electronic input devices, a cashout input that initiates a payout from the credit balance.

14. The method of claim 13, further comprising displaying on the electronic display device for the casino wagering game a component legend indicative of the respective component ratings and plurality of volatility components.

15. The method of claim 13, further comprising unlocking, based on gameplay, a player-selectable character from a plurality of player-selectable characters, the player-selectable character being associated with one or more volatility components of the plurality of volatility components.

16. The method of claim 13, further comprising:

displaying a volatility-selector; and changing, in response to a player selection, a volatility setting between a low volatility setting and a high volatility setting.

17. A method of operating a gaming system, the gaming system including a random element generator, one or more controllers, and a gaming machine, the gaming machine primarily dedicated to playing at least one casino wagering game, the gaming machine including a gaming cabinet, an electronic display device, and one or more electronic input devices, the electronic display device and the one or more electronic input devices being coupled to the gaming cabinet, the method comprising:

detecting, via at least one of the one or more electronic input devices, a physical item associated with a monetary value, the monetary value establishing a credit balance that changes based on play of the casino wagering game;

generating one or more random elements with the random element generator;

receiving, via at least one of the one or more electronic input devices, a wager input to initiate the casino wagering game, the wager input decreasing the credit balance, the casino wagering game being one of a plurality of casino wagering games that includes a first casino wagering game and a second casino wagering game;

randomly selecting, by the one or more controllers, an outcome of the casino wagering game based, at least in part, on the one or more random elements;

displaying the outcome on the electronic display device of the gaming machine; and displaying on the electronic display device of the gaming machine a plurality of volatility components with respective component ratings, the component ratings of all components of the plurality of volatility components being indicative of a total rating of an overall volatility;

assigning, by the one or more controllers, first component ratings to each component of the plurality of volatility components for the first casino wagering game and second component ratings to each component of the plurality of volatility components for the second casino wagering game, a first total rating of the first component ratings being the same as a second total rating of the second component ratings, at least one of the first component ratings being different than at least one of the second component ratings;

selecting the casino wagering game based on the component ratings;

awarding, by the one or more controllers, an award in response to the outcome meeting a predetermined award criterion; and receiving, via at least one of the one or more electronic input devices, a cashout input that initiates a payout from the credit balance.

18. The method of claim 17, wherein the selecting of the casino wagering game is in response to receiving a player selection.

19. The method of claim 17, further comprising, in response to adjusting one of the component ratings for the casino wagering game, changing another one of the component ratings for the casino wagering game with the total rating of the overall volatility remaining constant.

20. The method of claim 17, wherein each of the component ratings is represented via at least one of (i) a number of symbols and (ii) a size of the symbols, a smaller number of the symbols having a larger size being indicative of a higher overall volatility, a larger number of the symbols having a smaller size being indicative of a lower overall volatility.

* * * * *